US007869572B2

(12) United States Patent
Allen et al.

(10) Patent No.: US 7,869,572 B2
(45) Date of Patent: Jan. 11, 2011

(54) APPARATUS FOR REDUCING KV-DEPENDENT ARTIFACTS IN AN IMAGING SYSTEM AND METHOD OF MAKING SAME

(75) Inventors: Donald Robert Allen, Waukesha, WI (US); Brian Lounsberry, Thiensville, WI (US); James J. VanBogart, Ixonia, WI (US)

(73) Assignee: General Electric Company, Schenectady, NY (US)

( * ) Notice: Subject to any disclaimer, the term of this patent is extended or adjusted under 35 U.S.C. 154(b) by 4 days.

(21) Appl. No.: 12/116,736

(22) Filed: May 7, 2008

(65) Prior Publication Data

US 2009/0279669 A1 Nov. 12, 2009

(51) Int. Cl.

| | |
|---|---|
| ***H01J 5/18*** | (2006.01) |
| ***H01J 35/18*** | (2006.01) |
| ***H01J 35/16*** | (2006.01) |
| ***H01J 35/02*** | (2006.01) |

(52) U.S. Cl. ..... 378/140; 378/161; 378/203

(58) Field of Classification Search ..... 378/119, 378/121, 127, 139–144, 161, 199, 203; 250/496.1
See application file for complete search history.

(56) References Cited

U.S. PATENT DOCUMENTS

| | | | | |
|---|---|---|---|---|
| 3,018,398 | A * | 1/1962 | Atlee | 378/140 |
| 3,500,097 | A * | 3/1970 | Perry et al. | 378/140 |
| 4,309,637 | A * | 1/1982 | Fetter | 378/130 |
| 5,828,727 | A * | 10/1998 | Schild | 378/140 |
| 6,005,918 | A * | 12/1999 | Harris et al. | 378/140 |
| 6,252,933 | B1 * | 6/2001 | Artig | 378/121 |
| 6,301,332 | B1 * | 10/2001 | Rogers et al. | 378/142 |
| 6,594,341 | B1 * | 7/2003 | Lu et al. | 378/140 |
| 6,619,842 | B1 * | 9/2003 | Artig et al. | 378/203 |
| 7,042,981 | B2 | 5/2006 | Subraya et al. | |
| 2004/0071268 | A1 * | 4/2004 | Subraya et al. | 378/141 |
| 2004/0223588 | A1 * | 11/2004 | Subraya et al. | 378/141 |
| 2005/0226386 | A1 * | 10/2005 | Wang et al. | 378/140 |

* cited by examiner

*Primary Examiner*—Edward J Glick
*Assistant Examiner*—Anastasia Midkiff
(74) *Attorney, Agent, or Firm*—Ziolkowski Patent Solutions Group, SC

(57) ABSTRACT

An x-ray tube includes a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube further includes a window positioned to pass the beam of x-rays therethrough, an electron collector structure having an aperture formed therein to allow passage of x-rays therethrough, and a layer attached to the electron collector structure and configured to at least partially absorb or reduce diffraction of x-rays that contact the layer.

28 Claims, 5 Drawing Sheets

APPARATUS FOR REDUCING KV-DEPENDENT ARTIFACTS IN AN IMAGING SYSTEM AND METHOD OF MAKING SAME

BACKGROUND OF THE INVENTION

The invention relates generally to x-ray tubes and, more particularly, to an x-ray tube constructed to address kV-dependent artifacts that result from primary beam interaction with an electron collector of the x-ray tube.

X-ray systems typically include an x-ray tube, a detector, and an assembly to support the x-ray tube and the detector. In some applications, the assembly is rotatable. In operation, an object is located between the x-ray tube and the detector. The x-ray tube typically emits radiation, such as x-rays, toward the object such that the radiation typically passes through the object to impinge on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient positioned in a medical imaging scanner and an inanimate object as in, for instance, a package in a computed tomography (CT) package scanner.

X-ray tubes typically include an anode having a high density track material, such as tungsten, that generates x-rays when high energy electrons impinge thereon. The anode structure typically includes a target cap and a heat storage unit, such as graphite, attached thereto. X-ray tubes also include a cathode that has a filament to which a high voltage is applied to provide a focused electron beam. The focused electron beam comprises electrons that emit from the filament, which is typically constructed of tungsten, and are accelerated across an anode-to-cathode vacuum gap to produce x-rays upon impact with the track material. As the electrons impinge upon the track material and rapidly decelerate, a spectrum of x-rays is generated. X-rays generated within the anode emit therefrom and pass to the detector through, typically, a low density or low atomic number material such as beryllium, which is typically referred to as a "window."

X-ray generation results in a large amount of heat being generated within the anode. Much of the energy is dissipated via conduction into the target, where it is stored in the heat storage unit and radiated to the surrounding walls from the heat storage unit. Coolant surrounding the walls transfers the heat out of the tube. However, much of the energy, including up to 40% or more, may be back-scattered from the anode to impinge upon other components within the x-ray tube. Much of this back-scatter energy is deposited in and around the window, which can overheat the window and the joints that attach the window to the x-ray tube.

An electron collector, or back-scatter electron reduction apparatus, which is typically fabricated of copper and has coolant circulated therethrough, is designed to be thermally coupled to the window and to have an aperture aligned with the window to allow passage of electrons therethrough. Accordingly, the coolant removes the heat load from the window and the surrounding region, thus maintaining the window and its attachment joints at low temperatures during operation of the x-ray tube.

However, the electron collector typically includes a substantial amount of mass and volume in order to both sink the heat and house the coolant lines therein. Thus, the walls of the aperture typically have a substantial depth, such as a few centimeters or more. And, because the x-rays emit from the focal spot in all directions, some of the x-rays impinge upon the walls of the aperture. The material of the electron collector is typically a polycrystalline material such as copper having, therefore, a large grain structure in a number of crystal orientations. Thus, interaction of the x-ray beam with the walls of the aperture can result in lattice diffraction (i.e., Bragg diffraction), and if the incident beam strikes a crystal at the Bragg angle relative to a diffracting plane, a portion of the incident beam will be redirected from its original vector. The Bragg diffraction condition for $1^{st}$ order diffraction is given as $L=2*d*\sin(T)$, where L is the x-ray wavelength, d is the spacing between crystalline planes, and T is the diffraction angle. The diffracted beam will therefore result in an area of locally increased intensity that, when impacting on the detector, may give rise to an area of increased intensity, resulting in an image artifact.

A rotating anode x-ray tube generates a polychromatic spectrum of x-radiation. If the accelerating potential is below the K-edge of the anode track material, a Bremsstrahlung spectrum is generated. However, if the accelerating potential exceeds the K-edge for the track material, then characteristic radiation is also generated. The characteristic x-ray peaks increase dramatically in intensity relative to the Bremsstrahlung radiation as the tube accelerating potential is increased above the K-edge energy. In contrast, the intensity of the Bremsstrahlung increases gradually with increasing potential. Therefore, if x-rays of characteristic wavelength cause diffraction from the aperture, an image artifact can be generated that worsens as the accelerating potential increases above the K-edge energy, and any image artifact created cannot be easily calibrated out of the system due to the strong dependence on tube accelerating potential.

Therefore, it would be desirable to design a system and apparatus to reduce diffraction of x-rays within an electron collector of an x-ray tube without compromising the thermal performance of the electron collector.

BRIEF DESCRIPTION OF THE INVENTION

The invention provides a method and apparatus for reducing kV dependent image artifacts in an x-ray tube.

According to one aspect of the invention, an x-ray tube includes a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube further includes a window positioned to pass the beam of x-rays therethrough, an electron collector structure having an aperture formed therein to allow passage of x-rays therethrough, and a layer attached to the electron collector structure and configured to at least partially absorb or reduce diffraction of x-rays that contact the layer.

In accordance with another aspect of the invention, a method of manufacturing an x-ray tube includes the steps of positioning a cathode in a vacuum chamber, positioning an anode within the vacuum chamber to receive electrons emitted from the cathode and generate a beam of x-rays, and positioning a window proximately to the anode to receive the beam emitted from the anode. The method further includes attaching a first structure to the x-ray tube having an aperture therein that is positioned to allow passage of the primary beam of x-rays to the window, and attaching a second structure to a wall of the aperture.

Yet another aspect of the invention includes an x-ray tube positioned to emit the x-rays toward an object. The x-ray tube includes an anode positioned to generate the x-rays from electrons that impinge thereon, and a window material positioned to receive the x-rays. The x-ray tube further includes an electron collector attached to the x-ray tube and having an opening therein, the opening positioned to permit the x-rays to pass therethrough, and a material positioned in the opening, the material configured to attenuate or directionally deflect the x-rays that impinge thereon.

According to a further aspect of the invention, an x-ray tube includes a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube further includes a window positioned to pass the beam of x-rays therethrough, and a structure having an aperture formed therein to allow passage of x-rays therethrough and configured to at least partially absorb or reduce diffraction of x-rays that contact the structure.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
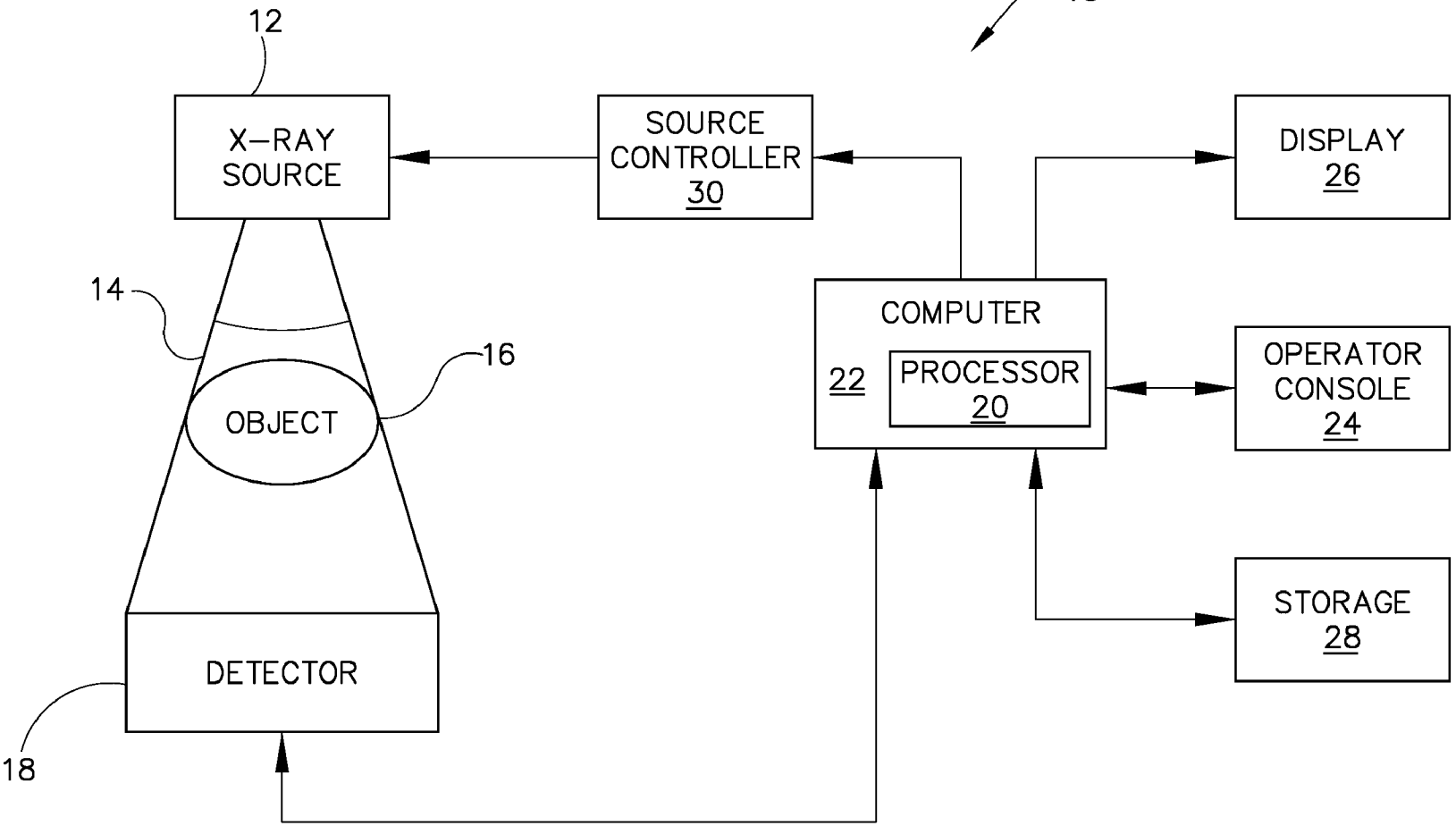
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
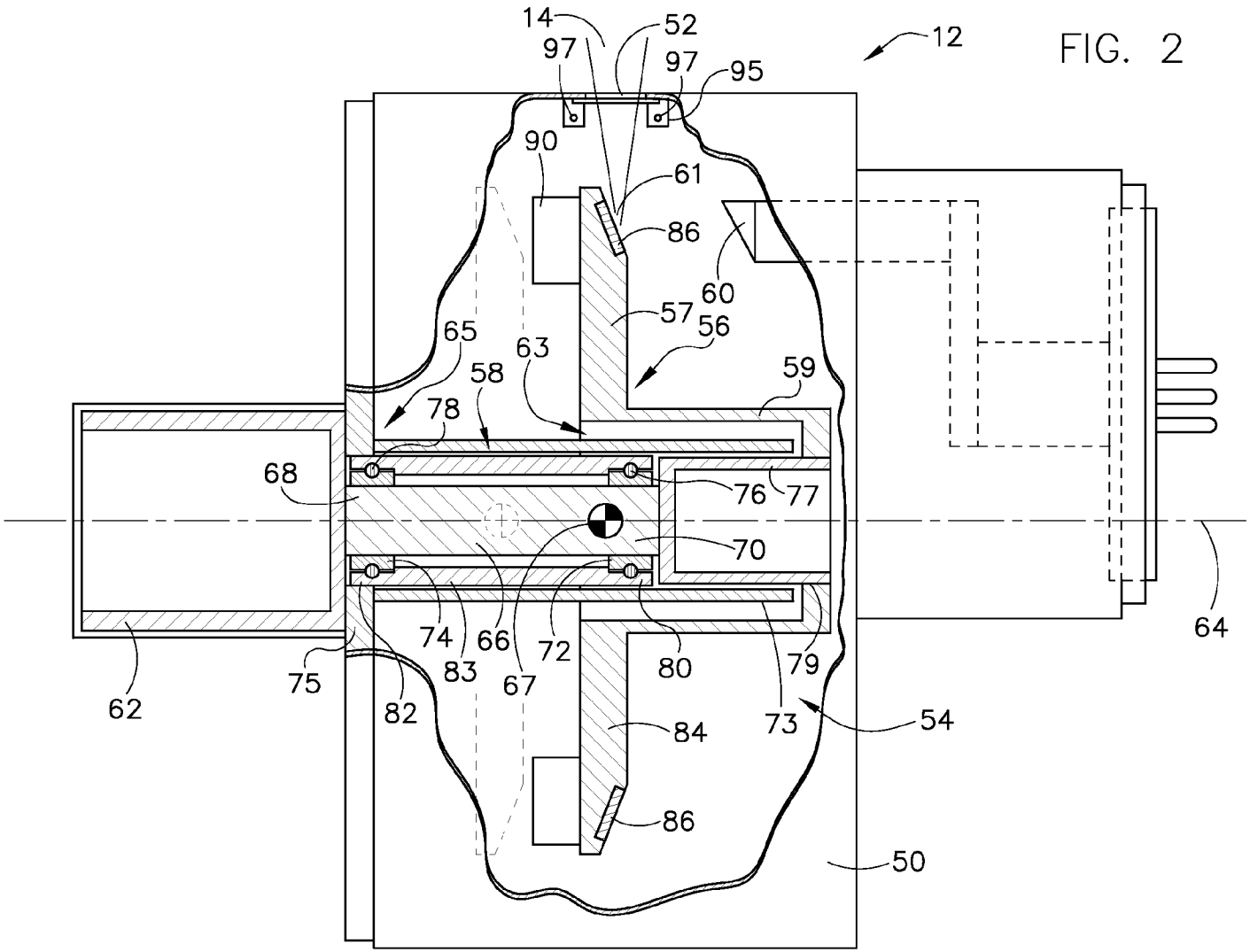
FIG. 2 is a cross-sectional view of an x-ray tube according to an embodiment of the invention and useable with the system illustrated in FIG. 1.

FIG. 2 illustrates a cross-sectional view of an x-ray tube insert 12 incorporating an embodiment of the invention. The x-ray tube insert 12 includes a vacuum chamber or frame 50 typically positioned within a casing (not shown). The frame 50 has a radiation emission passage 52 formed therein that may be referred to as a window, or window material. The frame 50 encloses a vacuum 54 and houses an anode 56, a bearing cartridge 58, a cathode 60, and a rotor 62. The anode 56 includes a target 57 having a target shaft 59 attached thereto. X-rays 14 are produced when high-speed electrons are decelerated when directed from the cathode 60 to the target 57 via a potential difference therebetween of, for example, 60 thousand volts or more in the case of CT applications. Operation may be bipolar (kV applied to both the cathode and the anode) or monopolar (kV applied to one of the cathode or the anode and having, for instance, an anode grounded operation). The electrons impact a target track material 86 at focal point 61 and a primary beam of x-rays 14 emit therefrom. The x-rays 14 emit through the radiation emission passage 52 toward a detector array, such as detector 18 of FIG. 1. To avoid overheating the target track material 86 from the electrons, the anode 56 is rotated at a high rate of speed about a centerline 64 at, for example, 90-250 Hz.

The bearing cartridge 58 includes a front bearing assembly 63 and a rear bearing assembly 65. The bearing cartridge 58 further includes a center shaft 66 attached to the rotor 62 at a first end 68 of center shaft 66, and a bearing hub 77 attached at a second end 70 of center shaft 66. The front bearing assembly 63 includes a front inner race 72, a front outer race 80, and a plurality of front balls 76 that rollingly engage the front races 72, 80. The rear bearing assembly 65 includes a rear inner race 74, a rear outer race 82, and a plurality of rear balls 78 that rollingly engage the rear races 74, 82. Bearing cartridge 58 includes a stem 83 which is supported by a back plate 75. A stator (not shown) is positioned radially external to rotor 62, which rotationally drives anode 56. The target shaft 59 is attached to the bearing hub 77 at joint 79. One skilled in the art will recognize that target shaft 59 may be attached to the bearing hub 77 with other attachment means, such as a bolted joint, a braze joint, a weld joint, and the like. In one embodiment a receptor 73 is positioned to surround the stem 83 and is attached to the x-ray tube 12 at the back plate 75. The receptor 73 extents into a gap formed between the target shaft 59 and the bearing hub 77.

Referring still to FIG. 2, the target 57 includes a target substrate 84, having target track material 86 attached thereto. The target track material 86 typically includes tungsten or an alloy of tungsten, and the target substrate 84 typically includes molybdenum or an alloy of molybdenum. A heat storage medium 90, such as graphite, may be used to sink and/or dissipate heat built-up near the focal point 61. One skilled in the art will recognize that the target track material 86 and the target substrate 84 may comprise the same material, which is known in the art as an all metal target.

The anode 56 has a re-entrant target design that serves to position the mass or center-of-gravity 67 of target 57 at a position between the front bearing assembly 63 and the rear bearing assembly 65 and substantially along centerline 64, about which center shaft 66 rotates. Additionally, both target shaft 59 and bearing hub 77 serve to increase a conduction path length between target 57 and bearing cartridge 58 such that a reduction in the peak operating temperature of front inner race 72, front balls 76, and front outer race 80 may be realized as compared to a direct connection of target 57 to second end 70 of center shaft 66. In one embodiment, as illustrated in phantom in FIG. 2, the center-of-gravity 67 of the target 57 is positioned equidistant between the front bearing assembly 63 and the rear bearing assembly 65. As such, the mechanical load of the target 57 is positioned between the two bearing assemblies 63, 65, thus causing the two bearing assemblies 63, 65 to wear at approximately equal rates. One skilled in the art will recognize that the positioning of target 57 in a re-entrant target design as illustrated also results in a combined center-of-gravity of target 57, target shaft 59, bearing hub 77, center shaft 66, and rotor 62 positioned between the front bearing assembly 63 and the rear bearing assembly 65. The distance of re-entrance of target 57 may be designed such that the combined center-of-gravity may be positioned equidistant between front bearing assembly 63 and rear bearing assembly 65 to cause two bearing assemblies 63, 65 to wear at approximately equal rates.

In operation, as electrons impact focal point 61 and produce x-rays 14, heat generated therein causes the target 57 to increase in temperature, thus causing the heat to transfer via radiation heat transfer to surrounding components such as, and primarily, casing 50. Heat generated in target 57 also transfers conductively through target shaft 59 and bearing hub 77 to bearing cartridge 58 as well, leading to an increase in temperature of bearing cartridge 58. The heat generated includes radiant thermal energy from the anode 56 and kinetic energy of back-scattered electrons that deflect off of the anode 56. The back-scattered electrons typically impinge upon an electron collector 95 positioned on and typically attached to the radiation emission passage 52. As such, back-scattered electrons that would otherwise impinge on the radiation emission passage 52, are intercepted by the electron collector 95. The electron collector 95 may include coolant lines 97 which carry coolant therethrough and reduce the operating temperature of the electron collector 95.

Figure 3:
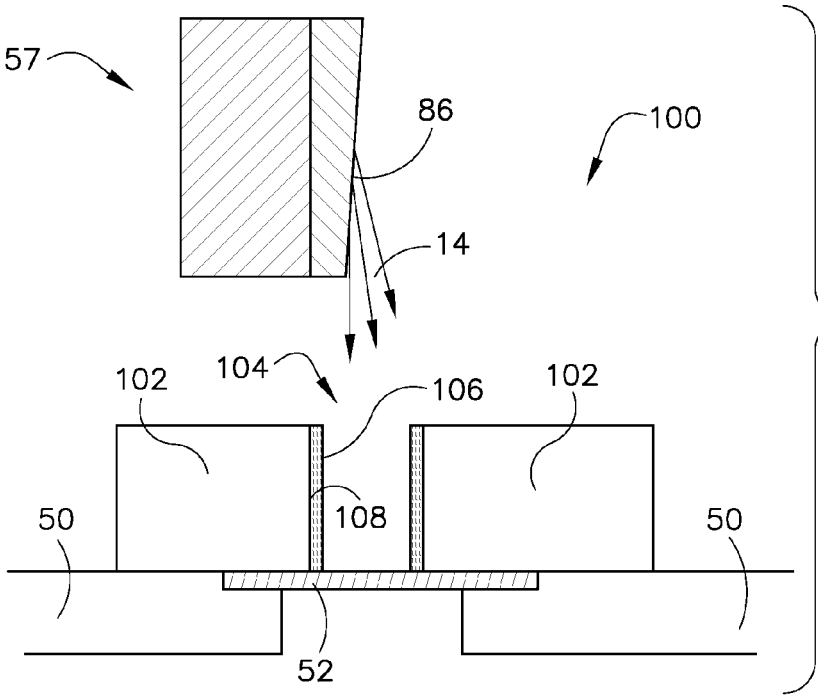
FIG. 3 is an illustration of an electron collector having an attenuating layer according to an embodiment of the invention.
Figure 4:
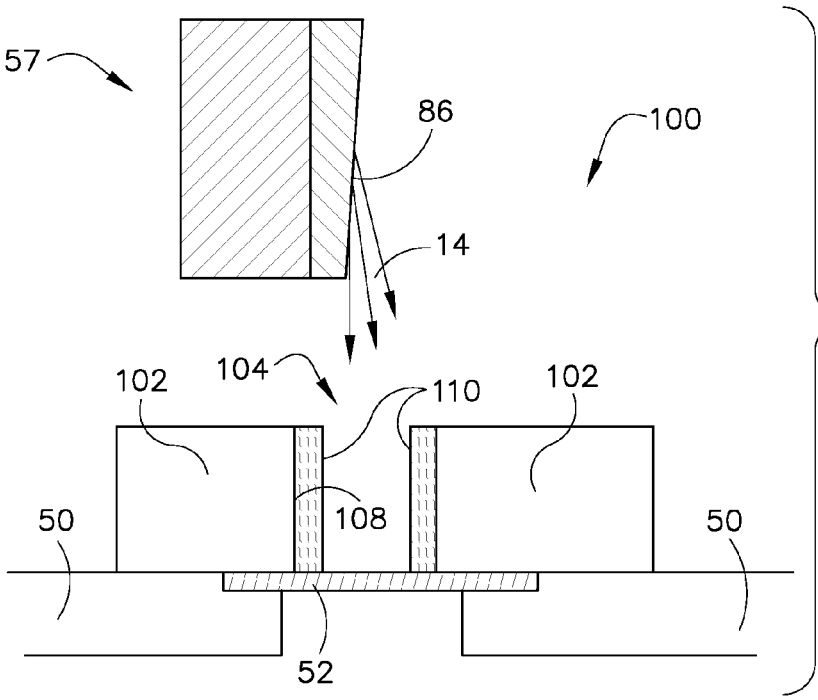
FIG. 4 is an illustration of an electron collector having a fine-grain structure material according to an embodiment of the invention.
Figure 5:
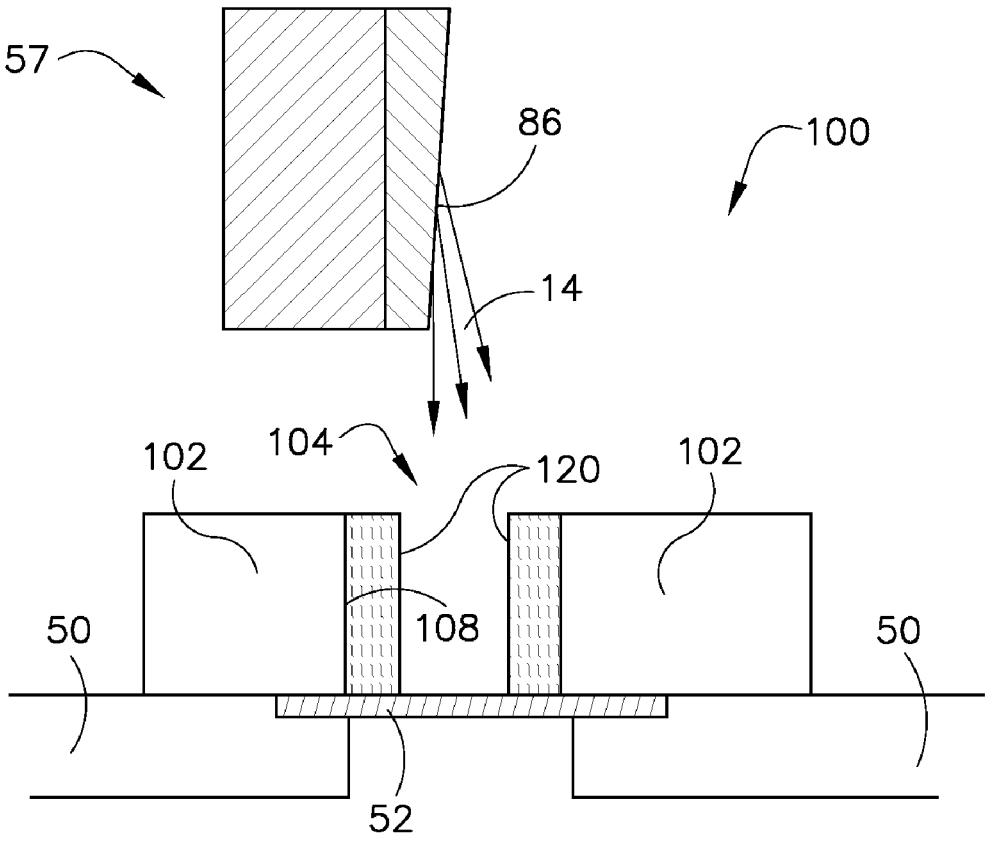
FIG. 5 is an illustration of an electron collector having a directionally-solidified structure or single crystal material according to an embodiment of the invention.

FIGS. 3-5 illustrate an electron collector 100 according to embodiments of the invention. An electron collecting material 102, such as copper, is attached to the radiation emission passage 52 and frame 50 as illustrated in FIG. 2. The electron collector 100 includes an aperture 104 that is positioned to allow passage of x-rays 14 therethrough that are emitted from the track material 86 of target 57. One skilled in the art will recognize that the electron collector 100 may be attached to the radiation emission passage 52, the frame 50, or both.

Referring now to FIG. 3, the electron collector 100 includes an attenuating layer according 106 to an embodiment of the invention. In this embodiment, an attenuating layer 106 is attached to a wall 108 of material 102. The attenuating layer 106 possesses both a fine-grain structure and strong x-radiation attenuation characteristics. According to embodiments of the invention, the attenuating layer 106 includes a material such as silver, gold, platinum, tungsten, and the like (and their alloys). Other materials that may be used for the attenuating layer 106 include, for example, hafnium, iridium, molybdenum, niobium, osmium, palladium, rhenium, rhodium, tantalum, etc. (and their alloys). The attenuating layer 106 may be applied to the material 102 by plating and other deposition processes known within the art. Alternatively, one skilled in the art will recognize that the attenuating layer 106 may be an insert of material that may be brazed, soldered, welded, or mechanically fastened to the aperture according to methods known within the art.

The thickness of the attenuating layer 106 typically ranges from 5-50 micrometers and is selected based on the angle of incidence of primary x-rays 14 and based on the characteristics of the attenuating material. Because the aperture 104 is typically located close to the track material 86, the angle of the incident beam relative to the wall 108 of the material 102 is typically 3-7°. As such, for an attenuating thickness, t, and an incident angle, A, the length of attenuating material through which x-rays 14 pass before reaching material 102 is given as t/sin(A). Thus, for $1^{st}$ order diffraction, given as L=2*d*sin(T) as discussed above, a diffracted beam (after being diverted from its original vector by an angle 2T due to diffraction) exiting the base material 102 of the aperture 104 travels through the attenuating layer 106 an additional distance of t/sin(2T-A), further amplifying the attenuation effect of the attenuating layer 106.

As an example, for tungsten x-rays of Kα wavelength that impact the wall 108 of the aperture 104 coated with a 10 micron layer of gold and having a 3° incident beam angle, 97% attenuation of the beam intensity is realized (for the strongest diffraction condition of copper, along the (111) lattice. And, for a 5° incident beam angle, the attenuation is 99.9%.

FIG. 4 is an illustration of an electron collector 100 having a fine-grain structure material according to an embodiment of the invention. In this embodiment, a material having a fine-grain structure 110 is attached to the wall 108 of the material 102. The material having the fine-grain structure 110 may include an insert of material that may be brazed, welded, or mechanically fastened to the aperture according to methods known within the art. Fine-grain structure inserts, according to this embodiment, may have a grain size of 100 microns or less, and may include but are not limited to copper-aluminum oxide powders such as Glidcop TM, or TZM (Ti—Zr—Mo). As such, because the intensity of a diffracted beam is proportional to the volume of the crystal being diffracted, an aperture constructed of this fine-grain material may reduce or eliminate kV-dependent artifacts.

FIG. 5 is an illustration of an electron collector 100 having a directionally-solidified structure or single crystal material according to an embodiment of the invention. In this embodiment, a single crystal or directionally-solidified structure 120 is attached to the wall 108 of the material 102 and may be formed or fabricated by methods understood in the art. Such a material may include, but is not limited to, a face-centered cubic metal such as copper (i.e., the (111) plane) that is positioned such that the highest intensity diffraction condition is not met by interaction of the incident beam with the electron collector 102. Such a material may further include a single crystal material, a polycrystalline material, or a material in which the crystal lattice is continuous and unbroken to the edges, with no grain boundaries.

Additionally, although FIGS. 3-5 illustrate embodiments of the invention having layers attached to the electron collector 100, one skilled in the art will recognize that the electron collector may be fabricated entirely of the layer materials described with respect to each embodiment.

Figure 6:
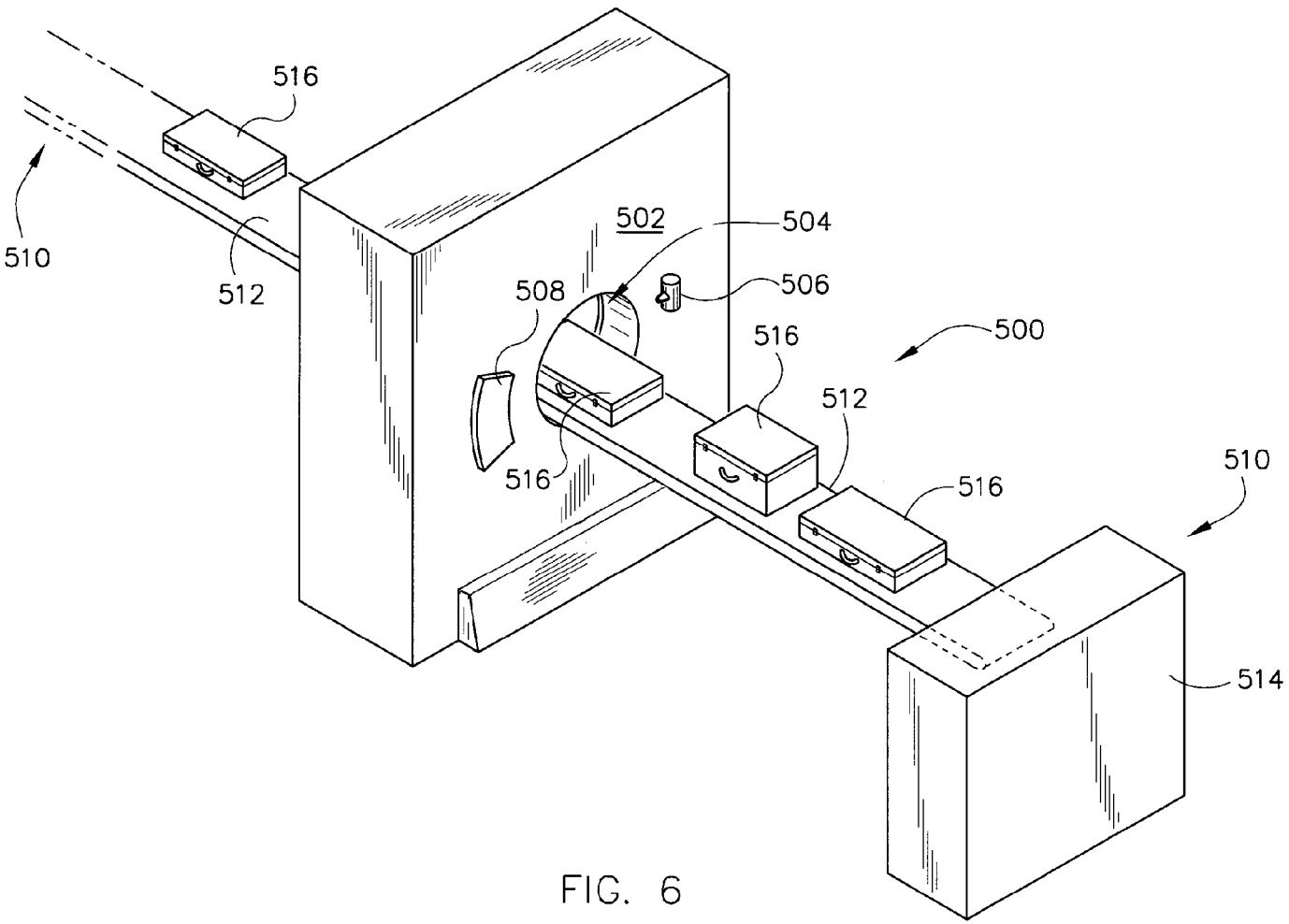
FIG. 6 is a pictorial view of an imaging system for use with a non-invasive package inspection system that can benefit from incorporation of an embodiment of the invention.

FIG. 6 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Therefore, according to one embodiment of the invention, an x-ray tube includes a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube further includes a window positioned to pass the beam of x-rays therethrough, an electron collector structure having an aperture formed therein to allow passage of x-rays therethrough, and a layer attached to the electron collector structure and configured to at least partially absorb or reduce diffraction of x-rays that contact the layer.

In accordance with another embodiment of the invention, a method of manufacturing an x-ray tube includes the steps of positioning a cathode in a vacuum chamber, positioning an anode within the vacuum chamber to receive electrons emitted from the cathode and generate a beam of x-rays, and positioning a window proximately to the anode to receive the beam emitted from the anode. The method further includes attaching a first structure to the x-ray tube having an aperture therein that is positioned to allow passage of the primary beam of x-rays to the window, and attaching a second structure to a wall of the aperture.

Yet another embodiment of the invention includes an x-ray tube positioned to emit the x-rays toward an object. The x-ray tube includes an anode positioned to generate the x-rays from electrons that impinge thereon, and a window material positioned to receive the x-rays. The x-ray tube further includes an electron collector attached to the x-ray tube and having an opening therein, the opening positioned to permit the x-rays to pass therethrough, and a material positioned in the opening, the material configured to attenuate or directionally deflect the x-rays that impinge thereon.

According to a further embodiment of the invention, an x-ray tube includes a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube further includes a window positioned to pass the beam of x-rays therethrough, and a structure having an aperture formed therein to allow passage of x-rays therethrough and configured to at least partially absorb or reduce diffraction of x-rays that contact the structure.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a vacuum chamber;

a cathode positioned within the vacuum chamber and configured to emit electrons;

an anode positioned within the vacuum chamber to receive the electrons emitted from the cathode and configured to generate a beam of x-rays from the electrons;

a window positioned to pass a portion of the beam of x-rays therethrough;

an electron collector structure having an aperture formed therein to allow passage of the portion of the beam of x-rays unimpeded therethrough toward the window, wherein the aperture is formed by a wall of the electron collector structure, and wherein a central beam of the portion of the beam of x-rays is substantially parallel to the wall; and a layer attached to the wall of the electron collector structure, the layer covering surfaces of the wall within the aperture which face each other across the aperture, and the layer configured to pass the portion of the beam of x-rays unimpeded toward the window, and the layer configured to at least partially absorb or reduce diffraction of x-rays of the beam of x-rays that contact the layer.

2. The x-ray tube of claim 1 wherein the layer comprises an x-ray attenuating material.

3. The x-ray tube of claim 2 wherein the attenuating material is applied to the electron collector by one of a plating and a deposition process.

4. The x-ray tube of claim 1 wherein the layer is an insert attached to the aperture via one of brazing, soldering, welding, and mechanical fastening.

5. The x-ray tube of claim 1 wherein the layer is attached to a surface of the aperture and comprises a material having a fine-grain structure.

6. The x-ray tube of claim 5 wherein the fine-grain structure comprises a copper-aluminum oxide composite.

7. The x-ray tube of claim 1 wherein the layer is attached to a surface of the aperture and comprises a directionally-solidified structure.

8. The x-ray tube of claim 1 wherein the x-rays of the beam of x-rays that contact the layer are primary x-rays.

9. The x-ray tube of claim 1 wherein the x-rays of the beam of x-rays that contact the layer are diffracted x-rays.

10. The x-ray tube of claim 1 wherein the layer is positioned to absorb primary x-rays.

11. The x-ray tube of claim 1 wherein the layer is positioned to absorb x-rays that diffract from the electron collector structure.

12. The x-ray tube of claim 1 wherein the layer absorbs primary x-rays and diffracted x-rays.

13. The x-ray tube of claim 1 wherein the layer is within the aperture.

14. A method of manufacturing an x-ray tube comprising the steps of:

positioning a cathode in a vacuum chamber;

positioning an anode within the vacuum chamber to receive electrons emitted from the cathode and generate a primary beam of x-rays;

positioning a window proximately to the anode to receive the primary beam of x-rays emitted from the anode;

attaching a first structure to the x-ray tube having an aperture therein that is formed by a wall of the first structure and positioned to allow unobstructed passage of a portion of the primary beam of x-rays to the window; and attaching a second structure to the wall of the aperture, the second structure covering surfaces of the wall within the aperture which face each other across the aperture and configured to allow unobstructed passage of the portion of the primary beam of x-rays to the window.

15. The method of claim 14 wherein the second structure comprises an x-ray attenuating material attached via one of a plating process and a deposition process.

16. The method of claim 14 wherein the second structure comprises a material having a fine-grain structure.

17. The method of claim 14 wherein the second structure comprises a material having a directionally-solidified structure.

18. The method of claim 14 wherein the step of attaching the second structure comprises attaching the second structure to the wall via one of brazing, mechanically fastening, soldering, and welding.

19. An x-ray system comprising:

an x-ray tube positioned to emit x-rays toward an object, the x-ray tube comprising:

an anode positioned to generate the x-rays from electrons that impinge thereon;

a window material positioned to receive the x-rays;

an electron collector attached to the x-ray tube and having a wall forming an opening therein, the opening positioned to permit some of the x-rays to pass unobstructedly therethrough toward the window material, wherein the some of the x-rays pass parallel to the wall; and a structure positioned on the wall of the opening, the structure covering surfaces of the wall within the opening which face each other across the opening and configured to attenuate or directionally deflect x-rays that impinge thereon, and unobstructedly pass the some of the x-rays toward the window.

20. The x-ray system of claim 19 further comprising a detector positioned to receive x-rays that pass through the object.

21. The x-ray system of claim 19 wherein the structure is an x-ray attenuating material.

22. The x-ray system of claim 19 wherein the structure is a fine-grain structure.

23. The x-ray system of claim 22 wherein the structure, having a fine-grain structure, comprises a copper-aluminum oxide powder.

24. The x-ray system of claim 19 wherein the structure is a directionally-solidified structure.

25. The x-ray system of claim 19 wherein the x-ray tube is a monopolar x-ray tube.

26. The x-ray system of claim 19 wherein the x-ray tube is a bipolar x-ray tube.

27. An x-ray tube comprising:

a vacuum chamber;

a cathode positioned within the vacuum chamber and configured to emit electrons;

an anode positioned within the vacuum chamber to receive the electrons emitted from the cathode and configured to generate a beam of x-rays from the electrons;

a window positioned to pass the beam of x-rays therethrough;

a structure having an aperture formed therein by a wall of the structure, the aperture configured to allow passage of x-rays therethrough without interaction and toward the window, the wall having a layer attached thereto that is positioned to pass some of the x-rays through the aperture and to the window without interaction, the layer covering edges of the wall within the aperture which face each other across the aperture and configured to at least partially absorb or reduce diffraction of x-rays received therein.

28. The x-ray tube of claim 27 wherein the structure is an electron collector.

* * * * *